US007234892B2

(12) United States Patent
Raaijmakers et al.

(10) Patent No.: US 7,234,892 B2
(45) Date of Patent: Jun. 26, 2007

(54) ROAD MARKING SYSTEM

(75) Inventors: Antonius Henricus Maria Raaijmakers, Eindhoven (NL); Jacob Cornelis Paul Den Dulk, Eindhoven (NL); Waltherus Emericus Johannes Van Gompel, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/504,656

(22) PCT Filed: Jan. 31, 2003

(86) PCT No.: PCT/IB03/00345

§ 371 (c)(1),
(2), (4) Date: Aug. 13, 2004

(87) PCT Pub. No.: WO03/069069

PCT Pub. Date: Aug. 21, 2003

(65) Prior Publication Data

US 2005/0079013 A1 Apr. 14, 2005

(30) Foreign Application Priority Data

Feb. 18, 2002 (EP) ..... 02075641

(51) Int. Cl.
*E01F 9/00* (2006.01)

(52) U.S. Cl. ..... 404/9

(58) Field of Classification Search ..... 404/9; 116/63 R; 359/531, 532
See application file for complete search history.

(56) References Cited

U.S. PATENT DOCUMENTS

| | | | | |
|---|---|---|---|---|
| 3,202,979 | A * | 8/1965 | Lemelson | 340/321 |
| 4,883,384 | A | 11/1989 | Hedgewick | |
| 5,421,669 | A | 6/1995 | Bertrand | |
| 5,839,816 | A | 11/1998 | Varga et al. | |
| 6,134,820 | A * | 10/2000 | Martinez | 40/586 |
| 6,206,557 | B1 * | 3/2001 | Sakuma et al. | 362/559 |
| 6,305,874 | B1 * | 10/2001 | Custers et al. | 404/9 |
| 6,789,915 | B2 * | 9/2004 | Van Der Poel et al. | 362/153.1 |

* cited by examiner

*Primary Examiner*—Gary S. Hartmann

(57) ABSTRACT

A road-marking system comprising at least a first (1) and a second road marking unit (2), each having an emission surface (10; 20), the first unit comprising a first light source (21, 21' . . . ) and the second unit comprising a second light source (22, 22' . . . ). Each unit has a housing (11, 12) of a shape adapted to a saw-cut cavity (9) accommodating the unit and lying in a plane P. Each unit is provided with stabilizers (23, 23'; 24, 24') which are situated at the ends of said emission surface and lie in the plane P as well, thus preventing turning of the unit around an axis A normal to the plane P.

13 Claims, 4 Drawing Sheets

ROAD MARKING SYSTEM

Figure 1:
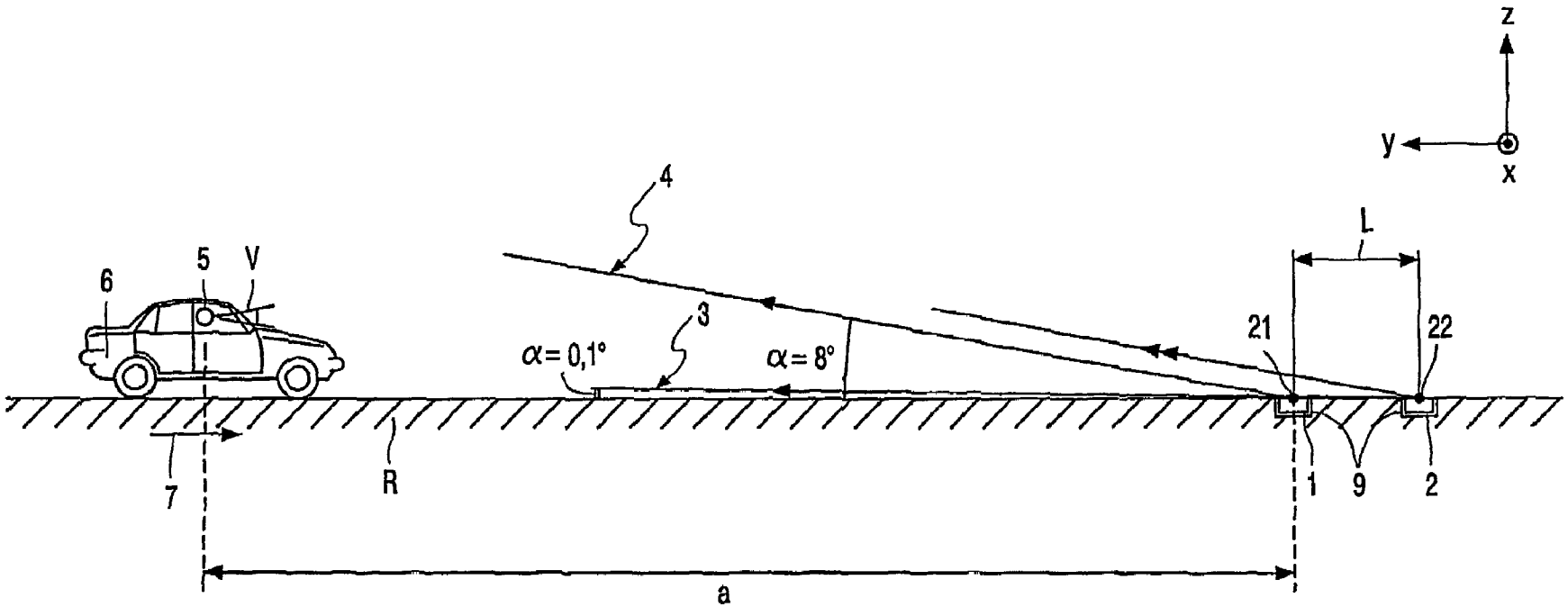

The invention relates to a road-marking system comprising:

at least a first and a second road-marking unit, each having an emission surface with opposed lateral ends, the first unit comprising a first light source and the second unit comprising a second light source, each unit having a respective housing with a circular-segment cylindrical bottom part, and the housing with the circular-segment cylindrical bottom part of each unit having an oppositely situated front surface and back surface on either side of a plane P.

The invention also relates to a road-marking unit and a road-marking complex.

Such a road-marking system is known from WO-01/92641 (PHNL000516). The road-marking system is used in traffic-control systems for marking traffic routes for vehicles, such as roads for cars and other road users, and runways for aircraft. One of the methods used by traffic planners in their attempts to reduce traffic jams is a so-called "tidal flow system". In such a dynamic system, the direction of the traffic of multi-lane roads is changed for one or more lanes in accordance with the direction of the main flow of traffic. In an alternative embodiment, the number of lanes available to traffic moving in a specific direction is increased or reduced, dependent upon the amount of traffic. A problem with these methods resides in indicating in a flexible manner the direction of the desired flow of traffic for a specific lane, or in changing the arrangement of the traffic route in a flexible manner. Known means for indicating the desirable direction of the flow of traffic include signaling lights alongside or above the traffic route.

Said road-marking systems cannot only be used as dynamic road-marking systems, but can also be used for static applications. Static applications of road-marking systems include marking parts of traffic routes (for example, straight parts or curves) so as to give guidance to the direction of the traffic in given weather conditions, for example, fog, rain, black ice, etc. and/or in given light conditions, such as daylight, twilight, a low position of the sun, night, etc.

Road-marking systems can be provided alongside and/or above the traffic route, for example, on a crash barrier at the side of the traffic route. Road marking systems can also be provided in a road surface of the traffic route by making cavities therein in which the known systems are to be accommodated/inserted. The known road-marking systems have the disadvantage that the unit, because of its saw-cut adapted shape, i.e. a circular segment cylindrical bottom part so as to be suitable to be accommodated in a saw-cut cavity in the road surface, is liable to turn when the unit is subjected to inhomogeneously distributed forces exerted thereon. Another disadvantage is that upon removal and/or insertion of a unit in the system, the operation of a relatively large number of units of the system is interrupted as the interconnection of the units extends through each respective unit.

It is an object of the invention to provide a road-marking system of the type described in the opening paragraph in which these disadvantages are counteracted.

According to the invention, this object is achieved in that each unit is provided at lateral ends of its emission surface, with respective stabilizers essentially extending alongside the plane P and/or the circular-segment bottom part is partly truncated as to form a flat surface and/or characterized in that the front an back surfaces are provided with spacers. Thus the respective unit is counteracted from turning around an axis A normal to the plane P and/or counteracted from tilting around an axis laying in plane P or by the addition of the stabilizers or the flat surface, the circular segment of the outer contour of the luminaire has been removed. The unit, when accommodated on the cavity, bears with its stabilizers and/or with its flat surface on the bottom wall of the cavity. The road-marking system of the invention is composed of separate units which may be electrically interconnected via grooves which extend perpendicularly to the plane P. The independent units do not form a large integral one-part array of units embedded in the road surface. Therefore, requirements with respect to skid resistance imposed on these units are relatively mild, since suitable contact between wheels of vehicles and the road surface is determined mainly by the road surface itself and only to a small degree by these units. The road-marking system of the invention has another advantage in that it is safer to road users when it is out of operation, as it does not form a continuous line/stripe in the road surface which, in given circumstances, might be mistaken for permanent "non-dynamic" road markings. The relatively small and shallow continuous groove of the saw-cut, which is made for the electrical/optical cables that electrically interconnect the units, does not lead to such confusion. As these stabilizers can be accommodated in the grooves already present for the electrical/optical cables, separate cavities in the road surface for accommodating the stabilizers are not necessary. The units thus connected to each other via electrical/optical cables in the grooves preferably have stabilizers of a shape adapted to cross-sections of the grooves. It is thus realized that the interconnection of the units passes alongside each unit instead of passing right though them, thus enabling insertion/removal of a unit without interrupting the functioning of the system. Preferably, the stabilizer has a reference surface facing away from the emission surface, which reference surface corresponds to a bottom surface of the groove. The unit can thus be positioned in a road via a simple drop-and-place method. Because of the shape of the unit, the emission surface of the unit protrudes only slightly, for example 2–4 mm, from the surface of the road provided with the recess in which the unit is accommodated. The stabilizers reduce the risk of turning of the unit with respect to the road surface due to forces exerted on the unit by the wheels of vehicles. The risk of the unit protruding too far from the road surface due to turning of the unit is thus counteracted. The risk of emission of light in undesired directions, possibly with subsequent distortion of an imaginary light line, is counteracted as well. In the description of the current invention, a "light source" is defined as a sub-unit which emits (visible) light, the origin of said light not necessarily being situated at the location of the light source. For example, light emitted by the light source may also be generated at a remote location and be transferred, for example, by means of light guides, such as optical fibers, from a so-called light generator to the light source. The term "light source" generally does not refer to light generated by reflection of light, in particular light emitted by a vehicle which is reflected at the location of the "light source". Furthermore, in this description, light beams exhibiting a "uniform overlap" are to be understood to mean light beams which cannot be distinguished by the human eye.

Each unit of the road-marking system is to be accommodated in a cavity provided in a road surface. The cavity, for example, in a road made of asphalt or concrete or ZOAB, i.e. "Zeer Open Asfalt Beton" (in English: "very open asphalt concrete"), has smooth walls of a relatively high mechanical strength. The unit and the cavity are adapted to each other in respect of shape, the known unit having a narrow fit in the cavity. It appeared though, that a perfect fit is very difficult to obtain, so that the unit is liable to tilt around an axis lying in plane P. To counteract such tilting an embodiment of the road-marking system is characterized in that the front and back surfaces are provided with spacers. The spacers are helpful in creating a slit between the front/back surfaces and the walls of the cavity. Said slits subsequently have to be filled with cement, enabling the unit accommodated in the cavity to bear against the walls of the cavity by way of practically its complete front/back surfaces and via the cement. The unit is thus kept in position and tilting is counteracted.

In an embodiment of the road-marking system at least one stabilizer comprises at least one recess, extending at least substantially parallel to the normal to the plane P, for accommodating electrical/optical cables. Each unit is connected, via electrical and possibly also optical cables, to a central control server. Consequently, each unit has to be fed with signals/energy from said server so as to operate adequately. Thereto, electrical/optical cables have to enter the unit from the grooves in which the cables are embedded; this can easily be achieved by providing said recesses in said stabilizers. As the cables often are forced to make sharp bends upon entering the unit, the recess in the stabilizer preferably has rounded edges/corners so as to counteract damaging of the cables at said sharp bends.

To further counteract damaging of the cables, in an embodiment of the road-marking system the recess is closed by a lid comprising a mechanical (pull) strain relief, e.g. by holding the cables with a clamping force.

In another road-marking system comprising at least a first and a second road-marking unit, each having an emission surface, the first unit comprising a first light source, and the second unit comprising a second light source, wherein each unit has at least one light channel with an opening at the emission surface, for enabling light from the light source to emerge from the emission surface, is characterized in that each light channel is provided with a light guide component which fits with a capillary spacing in the light channel. The capillary spacing enables relatively simple fixing of the component inside the light channel, for example, via gluing. To this end, glue is applied via an injection channel extending essentially transversely of the light channel. Due to capillary forces, the glue flows around the component and hence fills the capillary. There is no tendency of the glue to flow beyond the capillary. However, to counteract the risk of the glue flowing in the path of the light-wave, the road-marking system is also characterized in that a closing strip is provided at an internal end of the light channel within the unit in order to form an airtight connection between the light channel and the light source. Both the glue-filled capillary and the closing strip act as a barrier so that water and/or moisture cannot come into contact with electrical current-carrying parts inside the unit and subsequently cause short-circuiting. Thus, a more reliable unit is obtained.

Preferably, the component essentially consists of a material chosen from the group consisting of glass, hardened glass and sapphire. The component optionally might be provided with a scratch resistant coating. Said materials/coating are less liable to be damaged. Damaging of the component is thus counteracted, (e.g. scratching), so that it will not cause glare due to light scattered into undesired directions.

To (further) protect the light sources/light-guide component, the road-marking system is characterized in that the emission surface is provided with sloped guiding surfaces in the vicinity of the openings, said guiding surfaces extending transversely of the plane P. Thus, vehicles driving across the road-marking system will not have to overcome a sudden step in height due to the unit protruding from the road surface. Because the step in height is bridged gradually, it is also achieved that vehicles driving across said unit produce less noise.

To counteract collection of dirt in front of the opening, the road-marking system is characterized in that the emission surface has a slope in between the guiding surfaces in front of the openings, the slope extending away from the guiding surfaces in the direction away from the openings.

In a preferred embodiment of the road-marking system light beams emanate from the first and the second light source at an angle $\beta$ of 1 to 35° relative to the road surface, thus enabling a viewer who is relatively far away from the unit, i.e. more than 40 m, to see the light. The light has a beam width angle of about 45°, enabling a viewer who is relatively close to the unit, i.e. about 5 m, to see the light at an angle $\alpha$ of at least 45° relative to the road surface. It is thus achieved that a road user, for example, a motorist or a truck driver who, from his vehicle, looks ahead at the traffic on the road and the markings in the road surface, sees at a distance equal to or larger than 40 m, that the light beams emanating from the first light source in the first road-marking unit and from the second light source in the second road-marking unit exhibit a uniform overlap. Light originating from the first and the second light source at an angle $\alpha$ of 0.1 to 8° relative to the road surface is perceived as an imaginary "white" line in said circumstances. A suitable arrangement of openings, acting as a single light source, is a one-dimensional array of four openings per unit. Said four openings, where from light is emitted and which extend transversely of the viewing direction of the road user, are so closely spaced that the human eye cannot distinguish these four openings at a distance equal to or larger than 40 m. Said four openings thus appear as a single light source to the road user. The present invention can be particularly effectively used when the distance a between the road user and the first light source is in the range 40 m<=a<=100 m.

In a favorable embodiment of the road-marking system, an opto-electronic element can be used for the light source. The luminous flux of the opto-electronic element amounts to at least 1 lm, for example 5 lm, during operation. Opto-electronic elements, also referred to as electro-optical elements, such as electro-luminescent elements, for example, a LED, (i.e. a Light Emitting Diode), having a luminous flux which amounts to 5 lm during operation, can very advantageously be used as the light source. The opto-electronic element is preferably mounted in the road-marking unit; however, a combination with an optical fiber is alternatively possible. The luminous flux is relatively high and is necessary to generate enough light also in the presence of ambient light, for example, sunlight or light originating from headlights, so that the light beam can be sufficiently brightly perceived from a distance. LEDs have a relatively long service life, for example, 50,000 hours or more, so that the road-marking system has the advantage that maintenance costs potentially are significantly reduced. Another advantage is that LEDs are electronically dimmable light sources, since electronic dimming is more efficient than mechanical dimming. Optionally, the LED is combined with a collimator for collimating light from the LED and for directing the light through the opening in the emission surface. LEDs do not emit ultraviolet radiation, hence the unit and collimator can be made of synthetic materials, for example, plastic, without an increased risk of degradation due to the emitted light. Plastics involve relatively low system costs and offer increased system design possibilities. As an alternative light source for use in the road-marking system, use can very well be made of a LED with an end portion of an optical fiber. This has the advantage that the light emitted by the light source is generated in a light generator at a distance from the road-marking unit and transferred from the light generator to the light source by means of optical fibers. A further advantage of employing optical light guides is that the use of optical fibers results in a very efficient use of light, implying that there is no, or at least very little, luminous pollution. Luminous pollution is to be understood to mean the loss of light due to the fact that areas are illuminated where illumination is not necessary and/or undesirable. An advantage of the use of optical light guides with respect to the use of opto-electronic elements is that, in the case of optical fibers, no electric voltages and currents have to be fed to the light source via the road surface. This results in increased traffic safety. Furthermore, in the case of traffic accidents and other calamities, the risk of an electric voltage flash-over or a short-circuit, which might cause an explosion, is precluded.

The invention also relates to a road-marking complex which is provided with one or more road-marking systems in accordance with the invention, with a control system for the road-marking systems, and with means for coupling the road-marking systems to the control system. The means for coupling the one or more road-marking systems to the control system may be implemented as a cable for guiding electrical or optical signals. In a further version, the means for coupling are implemented as a wireless connection by means of an emitter/receiver pair, where the emitter sends control signals from the control system to a receiver incorporated in the road-marking complex.

Figure 2:
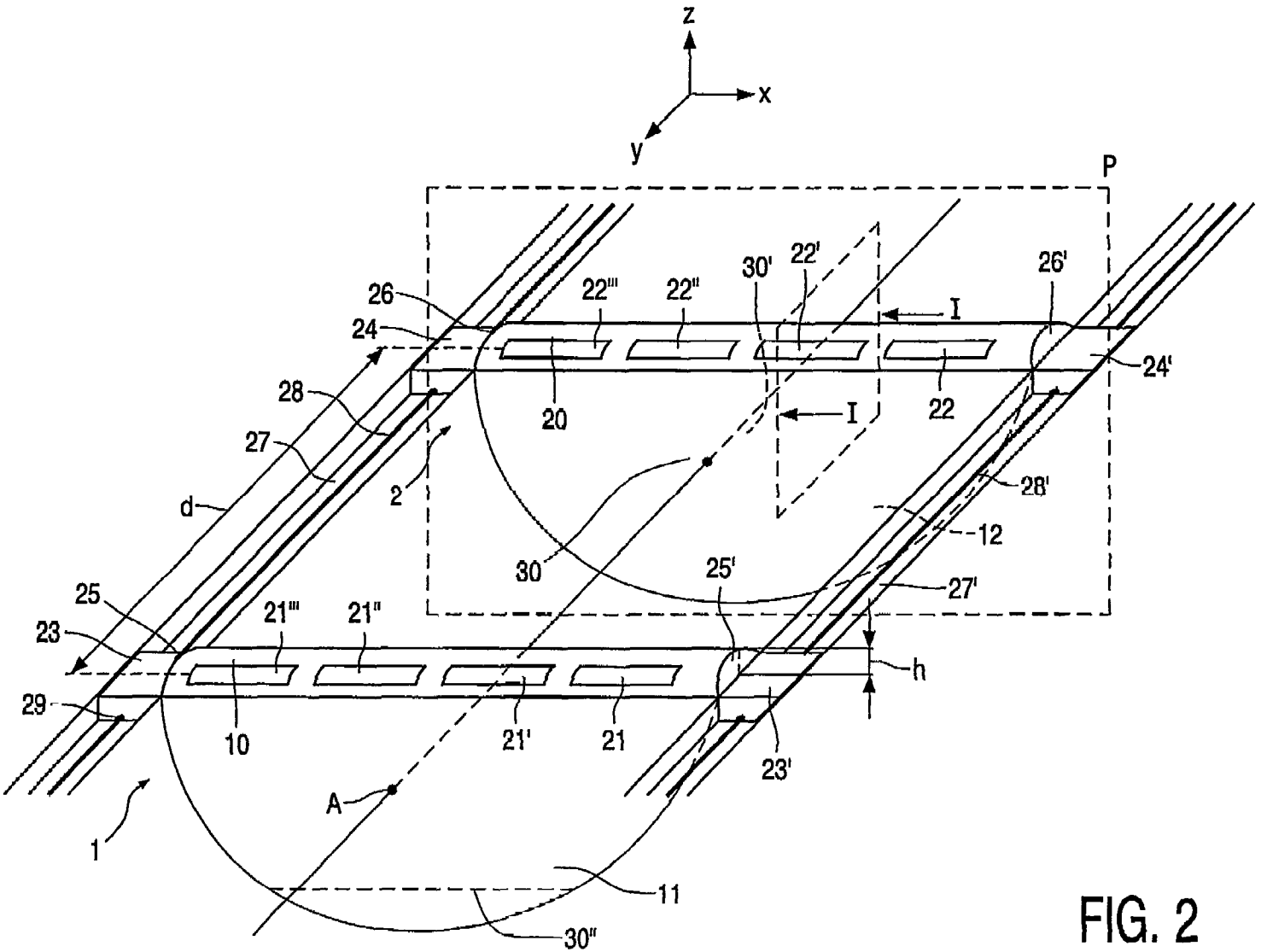
Figure 3:
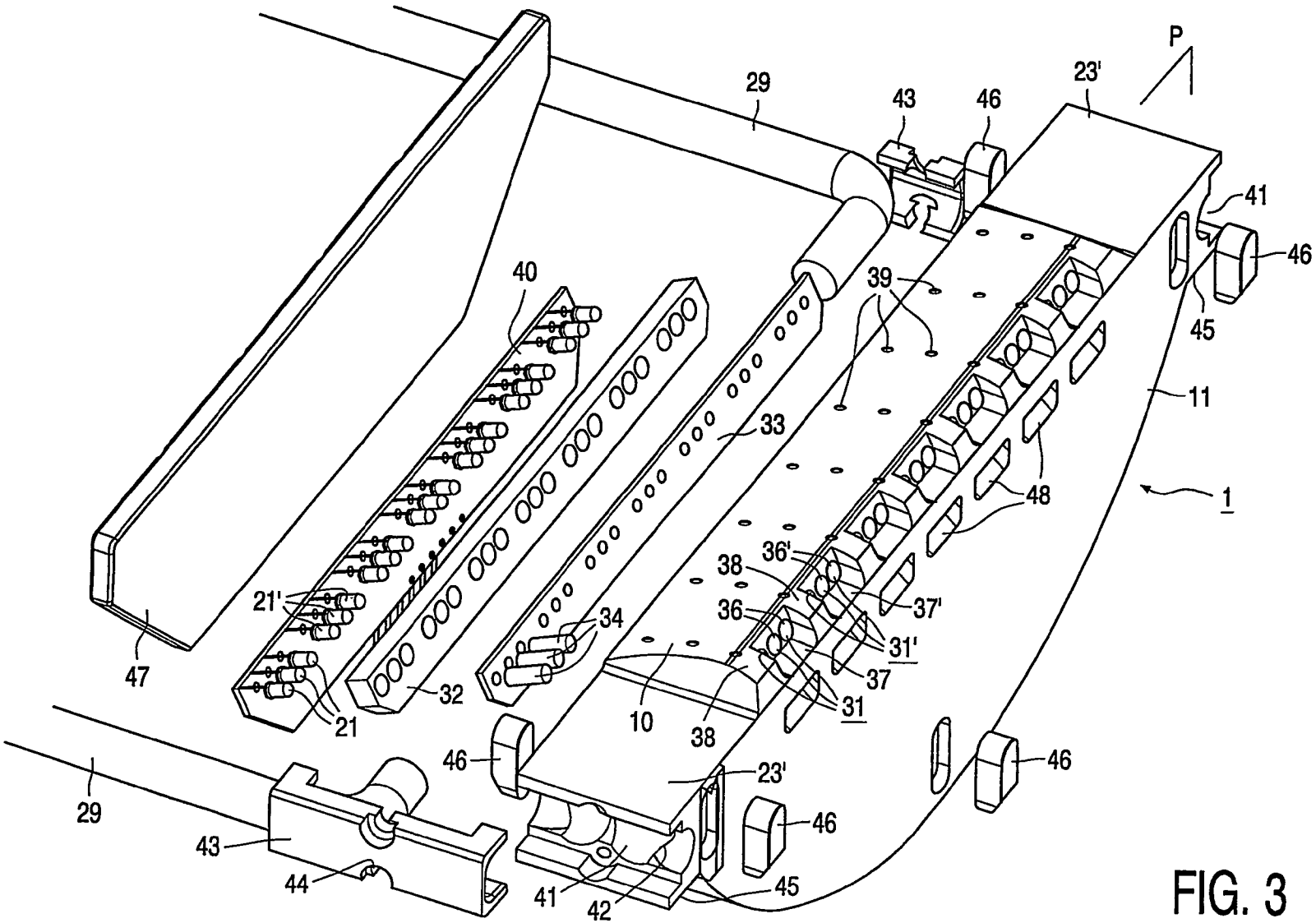
Figure 4:
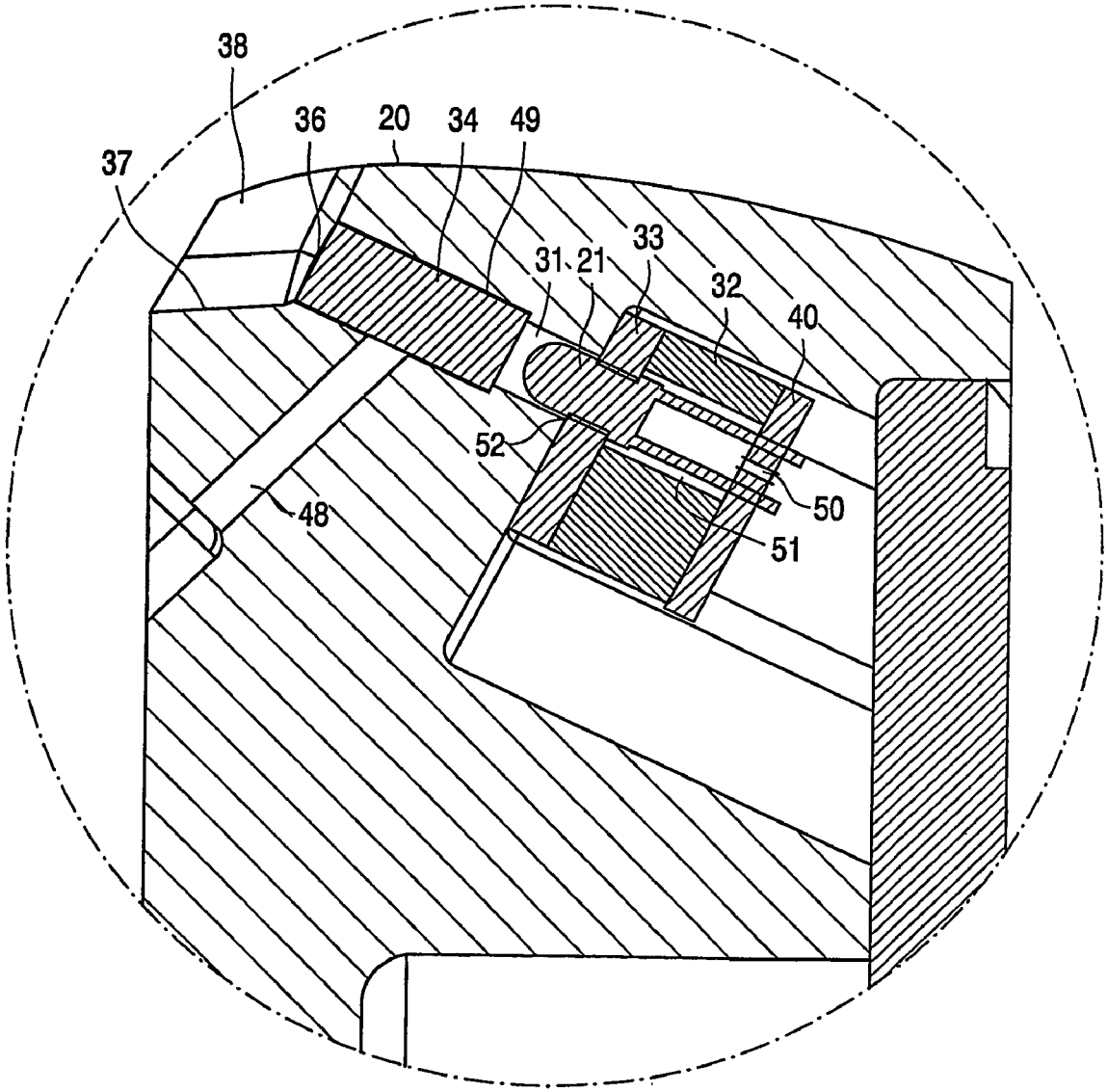

Embodiments of the road-marking system of the invention will be described in detail hereinafter, by way of non-limitative examples, with reference to the drawing. Therein:

FIG. 1 is a cross-sectional view of a road-marking system according to the invention, FIG. 2 is a perspective view of the road marking system with units of FIG. 1 accommodated in a road surface, FIG. 3 is an exploded view of an alternative embodiment of a road-marking unit according to the invention, and FIG. 4 is a cross-sectional view of an alternative embodiment of a road-marking unit according to the invention, taken a long the plane I—I of FIG. 2.

FIG. 1 is a cross-sectional view of a road-marking complex in accordance with the invention. Said road-marking complex comprises a first road-marking unit 1 and a second road-marking unit 2, which are both accommodated in and have an shape adapted to a respective cavity 9, made by a circular power saw in a road having a road surface R. In conformity with the first embodiment of the road-marking complex in accordance with the invention, as shown in FIG. 2, each of the road-marking units 1, 2 is composed of a housing 11, 12, each of which is provided with at least one light source on a respective emission surface 10, 20 of the housing; in this example four first light sources 21, 21', . . . are provided in the first housing 11, and four second light sources 22, 22', . . . in the second housing 12, the light sources in the figure being LEDs. To protect the light sources from damage, the first light sources 21, 21', . . . are recessed into the first housing 11, and the second light sources 22, 22, . . . are recessed into the second housing 12. Both in FIG. 1 and in FIG. 2, a co-ordinate system is shown for (mutual) orientation purposes. A plane which encloses an angle $\alpha$ relative to the first light source 21 is represented, in the cross-sectional view of FIG. 1, by means of a line 3, 4, where $\alpha$=0.1° for the line referenced 3 and $\alpha$=8° for the line referenced 4. An imaginary observer 5 who has a field of view V and is seated in a vehicle 6 moving in a direction 7 is situated at a distance a from the first light source 21 in the situation shown in FIG. 1, where the distance a>=40 m. In accordance with the invention, light beams emitted by the first and the second light source 21, 22 cannot be distinguished by the human eye having a field of view V. In other words, light beams emitted by the first and the second light source 21, 22 exhibit a uniform overlap in the plane enclosing an angle ($\alpha$) of 0.1 to 8° relative to a line L connecting the first light source 21 to the second light source 22, the distance a being >=40 m. In other words, light emitted by the first and the second light source 21, 22 is perceived as an imaginary line in the above conditions. Preferably, the distance a between the observer 5 and the first light source 21 is in the range 40<=a<=100 m. By way of example, the eye of a driver of a passenger car 6 is situated approximately one meter above the surface of the road and the eye of a truck driver is situated approximately 3 meters above the surface of the road. At a distance of, for example, 50 m from their vehicles, the driver of the car looks at the surface of the road R at a viewing angle of arc tan (1/50)=1.2°, and the truck driver looks at the surface of the road at a viewing angle of arc tan (3/50)=3.4°. These observers see that the light beams originating from the first and the second light source 21, 22 exhibit a uniform overlap at said distance.

FIG. 2 shows the specific shape of the housing 11, 12 of the units 1, 2, that is, adapted to a cavity obtained by a saw-cut by means of a circular power saw, i.e. a segment of a circle. The circular-segment cylindrical bottom part of each respective unit has an oppositely situated front surface 30 and back surface 30' on either side of a plane P. Also shown is the relative position of the units 1, 2 at a distance d, (being 18 cm in the figure) when installed in the road. Each unit is provided with two respective stabilizers 23, 23'; 24, 24' extending essentially alongside the plane P and being oppositely positioned at lateral ends 25, 25'; 26, 26' of their respective emission surface 10, 20 so as to prevent the respective unit from turning around an axis A normal to the plane P. Alternatively, or in addition the circular-segment cylindrical bottom part may be partly truncated as to form a flat surface 30", indicated in the Fig. by a dotted line. The stabilizers are embedded in grooves 27, 27' and are provided with recesses 29 enabling electrical/optical cables 28, 28' to pass alongside and through said recesses in the units. The units are electrically/optically interconnected by these cables by way of electrical/optical connectors provided in the stabilizers of each unit. A unit can thus be inserted into and removed from the system without interrupting the operation of the system. The emission surface 10, 20 protrudes a height h from the road surface R, h being in the range from 2 to 5 mm.

FIG. 3 is an exploded view of an embodiment of the unit 1, having a housing 11 with the shape of a hollow circular-segment cylinder and an insertion opening in its emission surface 10. The following parts are inserted in the housing 11: a printed circuit board 40 on which a plurality of Light Emitting Diodes (LEDs) 21, 21' . . . , are mounted, the LEDs extending through a spacer plate 32 and a closing strip 33 and into light channels 31. The closing strip 33 provides an airtight connection between the light channel and the LEDs. The closing strip offers the additional advantage that it counteracts vibrations of the LEDs, thus improving the service life of the unit. The spacer plate 32 enables the printed circuit board 40 to be pressed uniformly onto the closing strip 33. Because of the light channels 31, 31', . . . , in which light-guide components, in the Fig. glass rods 34 are fixed between the LEDs and openings 36, 36', . . . in the emission surface 10, the light from the LED 31 is emitted through the openings 36, 36', . . . ; the openings have a cross-section of about 1.5 mm and the light encloses an angle β of about 25° relative to the road surface. The emission surface has slopes 37, 37', . . . which are situated between guiding surfaces 38, 38', . . . and extend away from the guiding surfaces in the direction away from the openings. The emission surface 10 is provided with tracer holes 39 which are indicators for the wear of the units, so that units can be replaced before they fail due to excessive much wear. Each stabilizer 23, 23' comprises a recess 41 extending at least substantially parallel to the normal to the plane P in order to pas electrical/optical cables 29. The recess 41 has rounded edges/corners 42 so as to counteract damaging of the cables 29. The recess is closed by a lid 43 comprising a mechanical (pull) strain relief 44. The stabilizers 23, 23' each have a reference surface 45 facing away from the emission surface. The front surface 30 and the back surface 30' are provided with spacers 46; in said front surface 30 beginnings of injection channels 48 are shown. A closing plate 47 is provided so as to close the unit.

FIG. 4 shows the unit in a cross-sectional view alongside the plane I—I of FIG. 2, that is, in the assembled condition in the housing 11 of the unit. The LED 21 is mounted on the printed circuit board 40. The printed circuit board has gaps 50 enabling a glueing compound to be inserted into the spaces 51 in the spacer plate 32 so as to counteract vibration of the LED. The glueing compound also counteracts the ingress of water and/or moisture into the unit and short-circuiting, caused thereby. Thus, a more reliable unit is obtained. The LED is pressed by the spacer plate 32 onto the closing strip 33, said strip being provided at an internal end 52 of the light canal. In front of the LED the glass rod 34 is fixed in the light channel 31 in which the rod fits with a capillary spacing 49, the capillary spacing being filled with glue injected via the injection channel 48. The rod 34 extends through the light channel to the opening 36, provided in between the guiding surfaces 38. The emission surface 20 has a slope 37 in front of the opening 36.

The invention claimed is:

1. A road-marking system comprising:

at least a first and a second road-marking unit, each having an emission surface with opposed lateral ends, the first unit comprising a first light source and the second unit comprising a second light source, each unit having a respective housing with a circular-segment cylindrical bottom part, at least one of the respective housings having an oppositely situated front surface and back surface on either side of a plane, wherein the unit having the at least one of the respective housings is provided with at least one of:

at lateral ends of its emission surface, respective stabilizers essentially extending alongside the plane or a partial truncation of the circular-segment cylindrical bottom part as to form a flat surface or spacers provided to the front and back surfaces of the at least one of the respective housings.

2. A road-marking system as claimed in claim 1, wherein at least one of the units has the stabilizers and at least one stabilizer has a reference surface facing away from the emission surface.

3. A road-marking system as claimed in claim 1, wherein at least one of the units has the stabilizers and at least one stabilizer comprises at least one recess extending at least substantially parallel to the normal to the plane.

4. A road-marking system as claimed in claim 3, wherein the recess is closed by a lid comprising a mechanical (pull) strain relief.

5. A road-marking system as claimed in claim 1, wherein the emission surface of at least one of the units is provided with at least one opening for a light channel capable of transmitting light from the respective light source of the at least one of the units and wherein the emission surface is provided with a sloped guiding surface extending transversely to the plane and in the vicinity of the at least one light channel opening in the emission surface.

6. A road-marking system as claimed in claim 5, wherein the emission surface has a slope in between the sloped guiding surface and a second guiding surface in front of the openings.

7. A road-marking system as claimed in claim 1, wherein during normal operation of the system, light beams emanating from the first and the second light source at the emission surface of the respective unit are emitted at an angle β in the range $1<=\beta<=35°$ relative to the emission surface.

8. A road-marking system as claimed in claim 1, wherein during normal operation of the system, light beams emanating from the first and the second light source at the emission surface of the respective unit overlap each other at a distance >=40 m from the first light source in a plane which encloses an angle α, where $0.1<=\alpha<=8°$ relative to a line L interconnecting the first and the second light source.

9. A road-marking system as claimed in claim 1, wherein the light source is an opto-electronic element comprising a light emitting diode.

10. A complex for marking roads, comprising one or more road-marking systems as claimed in claim 1, a control system for the road-marking systems and means for coupling the road-marking systems to the control system.

11. A road-marking system as claimed in claim 9, wherein the opto-electronic element comprising a light emitting diode is in a combination with a light guide.

12. A road-marking unit for use in a road-marking system, comprising an emission surface and a light source, light beams emanating from the emission surface of said unit during normal operation, a housing comprising oppositely situated front and back surfaces on either side of a plane and a cylindrical bottom part, having a cross section that is a segment of a circle, wherein at the ends of its emission surface the unit is provided with respective stabilizers essentially extending alongside the plane, and the—bottom part is partly truncated as to form a flat surface;

wherein the front and back surfaces are provided with spacers, and wherein the road-marking system comprises:

at least a first and a second road-marking unit, each having a respective first or second emission surface with opposed lateral ends, the first unit comprising a first light source and the second unit comprising a second light source, each unit having a respective housing with a circular-segment cylindrical bottom part, at least one of the respective housings having an oppositely situated front surface and back surface on either side of an at least one of the respective housings plane, wherein the unit having the at least one of the respective housings is provided with at least one of:

at lateral ends of its emission surface, respective stabilizers essentially extending alongside the lane, or a partial truncation of the circular-segment cylindrical bottom part as to form a flat surface, or spacers provided to the front and back surfaces of the at least one of the respective housings.

13. A road surface provided with a road-marking system as claimed in claim 1 or with at least two road marking units as claimed in claim 12.

* * * * *